United States Patent [19]

Muhl

[11] Patent Number: 4,553,486

[45] Date of Patent: Nov. 19, 1985

[54] BEVERAGE DISPLAY SHELVING

[76] Inventor: Bradley G. Muhl, Keomah Village, Oskaloosa, Iowa 52577

[21] Appl. No.: 453,713

[22] Filed: Dec. 27, 1982

[51] Int. Cl.[4] ..... A47B 9/00

[52] U.S. Cl. ..... 108/108; 108/96; 211/187; 211/193

[58] Field of Search ..... 211/189, 193, 187, 182; 108/108, 110, 96, 97; 411/399

[56] References Cited

U.S. PATENT DOCUMENTS

| | | | |
|---|---|---|---|
| 1,627,912 | 5/1927 | Lomason | 411/399 |
| 3,164,255 | 1/1965 | Jay | 211/193 |
| 3,263,821 | 8/1966 | Klene et al. | 108/108 |
| 3,550,785 | 12/1970 | Seiz | 211/193 |
| 4,032,165 | 6/1977 | Russell | 211/189 |
| 4,159,814 | 7/1979 | Fibus | 211/193 |
| 4,204,480 | 5/1980 | Hanna | 108/108 |

FOREIGN PATENT DOCUMENTS

| | | | |
|---|---|---|---|
| 677364 | 11/1962 | Italy | 108/81 |

*Primary Examiner*—William E. Lyddane
*Assistant Examiner*—Joseph Falk
*Attorney, Agent, or Firm*—Zarley, McKee, Thomte, Voorhees & Sease

[57] ABSTRACT

A pair of L-shaped support members each include integrally connected vertical and horizontal channel members on which a shelf member and back member are supported. The horizontal channel member tapers rearwardly and the vertical channel member tapers upwardly. Uprights are bolted to the vertical channel members and carry brackets for supporting shelves. The lowest shelf is positioned directly above the floor on the horizontal channel members.

7 Claims, 6 Drawing Figures

BEVERAGE DISPLAY SHELVING

BACKGROUND OF THE INVENTION

Conventional store shelving includes standards to which base units are connected and which carry a bottom shelf which is positioned substantially above the floor which consequently wastes considerable space below the bottom shelf.

In the display of beverages particularly there is no need to have the bottom shelf elevated since the beverage cartons are large enough to be readily seen and handled. It is desirable to provide as much space for as many cartons as possible and the space that exists under the bottom shelf is wasted space that could be utilized for displaying and storing merchandise.

SUMMARY OF THE INVENTION

This invention comprising basically two L-shaped support members allows for quick and easy conversion of existing store shelving to the shelving system of this invention which provides a maximum of display space substantially all the way to the floor.

Each L-shaped support member includes a pair of channel members welded together with the horizontal channel member facing downwardly and the vertical member facing forwardly. The channel members taper rearwardly and upwardly to slope the shelf rearwardly and the back member rearwardly to maintain them in place as well as the product on the shelf. The vertical channel members easily connect to existing uprights upon removal of the existing base units. The uprights are then supported by the L-shaped support members and carry additional shelves on brackets above the bottom shelf for display of additional merchandise including beverages.

The assembly of the display shelving system including individual display units is easily accomplished on the site by removing the base units and bolting the uprights to the vertical channel members and interconnecting the L-support members by cross members which assist in supporting the load on the shelf and against the back member.

DESCRIPTION OF THE PREFERRED EMBODIMENT

Figures 1, 2, 3, 4, 5, 6:
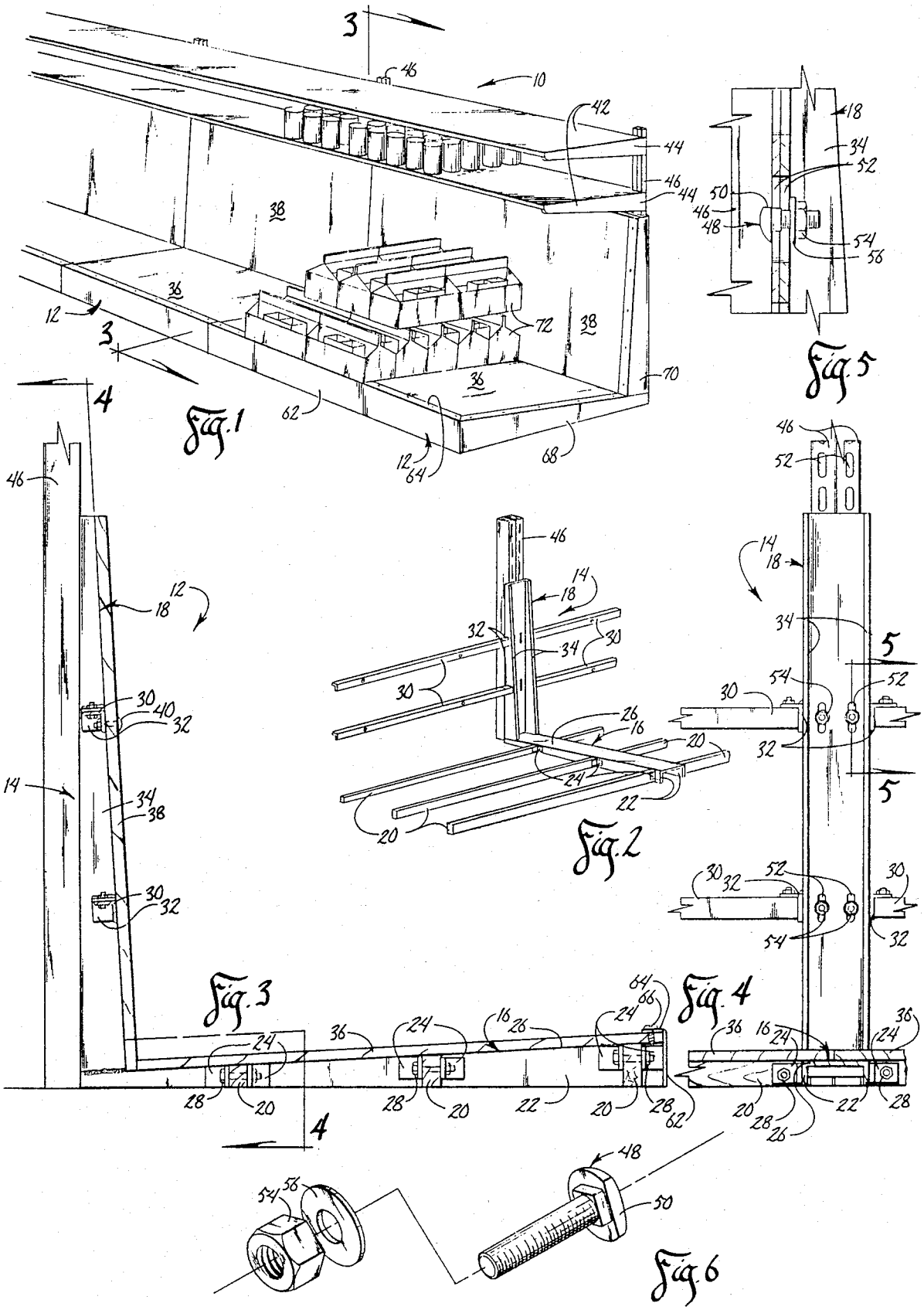
FIG. 1 is a perspective view of the freestanding beverage display shelving system of this invention.
FIG. 2 is a fragmentary perspective view of an L-shaped support member connected to uprights and including cross members.
FIG. 3 is a cross-sectional view taken along line 3—3 in FIG. 1.
FIG. 4 is a cross-sectional view taken along line 4—4 in FIG. 3.
FIG. 5 is a cross-sectional view taken along line 5—5 in FIG. 4.
FIG. 6 is an exploded perspective view of the fastener used to secure the vertical channel member to the upright.

The freestanding beverage display shelving system of this invention is referred to generally in FIG. 1 by the reference numeral 10 and includes individual display units 12.

Each individual display unit 12 includes a pair of L-shaped support members 14 which in turn are constructed from a horizontally downwardly facing channel member 16 and a forwardly facing vertical channel member 18. Each of the channel members, as seen in FIG. 3, taper rearwardly on the bottom channel members 16 and upwardly on the vertical channel member 18.

Wood cross members 20 are secured to the side legs 22 of the horizontal channel members 16 by L-shaped brackets 24. It is seen that each of the cross members 20 progressively decrease in height from the front to the rear such that they are supported on the floor and have a top surface in a common plane with the top surface 26 of the horizontal channel member 16. Bolts 28 are provided for interconnecting the two L-shaped brackets to the cross member 20 positioned therebetween.

Metal cross members 30 are fastened to the vertical channel members 18 through use of L-shaped brackets 32 as seen in FIG. 4. The forward faces on the cross members 30 are in a plane with the forward edges 34 of the legs of the channel member 18 to provide a uniform support surface between the vertical channel members 18.

A shelf of plywood or the like 36 is placed on the horizontal channel members 16 while a back member 38 is placed against the vertical channel members 18. No fastener is needed to maintain the shelf 36 in place due to the tapered support surface that tilts the shelf toward the back member. A screw fastener 40 may be utilized to insure that the back member 38 remains upright although it should not be necessary since the taper of the vertical members 18 causes the back member to lean rearwardly.

Conventional shelving 42 carried on shelf brackets 44 connected to upright standards 46 is shown in FIG. 1 with the vertical channel members 18 being connected by bolts 48 to the uprights 46. As seen in FIG. 6, the bolts 48 have elongated heads with flat side edges 50 which allow them to be inserted through elongated vertical slots 52 and then turned 90° to lock them in place attached to the uprights 46. A nut and washer 54 and 56 are provided on the forward face of the vertical channel 18 between the channel legs 34.

As further seen in FIG. 4, adjacent display units 12 may be assembled to a common L-shaped support member 14 whereby a pair of uprights 46 are bolted to the common vertical channel member 18. The lower shelf 36 of each unit meets along adjacent edges the adjacent shelf on the vertical centerline of the L-shaped support member 14.

A base plate 62 extends along the front of the unit from the floor to the top of the shelf 36 where a horizontally disposed flange 64 extends over the top edge of the shelf 36 and is secured in placed by a screw 66. The exposed end, as seen in FIG. 1 of the end unit may also include end face plates 68 and 70 secured to the shelf 36 and the back member 38.

Thus in operation it is seen that a freestanding beverage display shelving system may be constructed on the site in the store utilizing all new components or existing shelving may be modified containing only the uprights 46 from which lower base units not shown are removed. These uprights then are supported by the vertical channel members 18 by the bolts 48. Thus it is seen that a substantial additional space is gained by lowering the lowest shelf 36 closer to the floor and thereby allowing an additional layer of beverage cartons 72 to be stacked on the lower shelf 36 as seen in FIG. 1.

What is claimed is:

1. A freestanding beverage display shelving system comprising, a display unit including a pair of horizontally spaced apart L-shaped support members, each support member including a horizontally disposed channel member adapted to be supported by the floor and integrally connected at its inner end to the lower end of a vertically disposed channel member, a back member vertically disposed and positioned against said vertically disposed channel members and operatively supported on said horizontally disposed channel members, a shelf member horizontally disposed and positioned on said horizontally disposed channel members;

said vertical channel members being tapered from bottom to top to position the back member at angle to the vertical and to maintain the back member by gravity against the vertical channel members;

said horizontal channel members being tapered front to rear to maintain the shelf member by gravity operatively against the vertical channel members and maintain beverage products toward the inner rear end of the shelf member;

said L-shaped support members being interconnected by spaced apart cross members to provide support for said shelf member and said back member;

said cross members on said horizontal channel members being supported along their bottom sides by the floor and the height of said cross members from the front to rear being sequentially shorter corresponding to the taper of said channels to provide a top shelf supporting surface in a common horizontal plane including the top surface of said horizontal channel members.

2. The structure of claim 1 wherein said vertical channel members face forwardly thereby presenting rearwardly facing flat surfaces which engage upright members secured thereto by fasteners, said upright members extend substantially above the upper ends of said vertical channel members and support shelf brackets which in turn support shelves positioned vertically over said shelf member.

3. The structure of claim 1 wherein said cross members are at their opposite ends secured to said vertical and horizontal channel members by pairs of spaced apart L-shaped brackets mounted on the side legs of said channel members.

4. The structure of claim 1 wherein a second display unit is provided which utilizes one L-shaped support member of said first display unit and includes an oppositely disposed L-shaped support member with back and shelf members for each of said first and second display units meeting at their adjacent end edges in a plane extending through the longitudinal center of said one L-shaped support member.

5. The structure of claim 4 wherein a second pair of uprights are provided for said second display unit with one of them being positioned in side-by-side relationship to one of said first pair of uprights on one of said vertical channel members.

6. The structure of claim 5 wherein said fasteners securing said vertical channel members to said uprights include elongated head elements fitted into elongated slots in said uprights and turned 90° to retain said fasteners in locking relationship to said uprights during use.

7. The structure of claim 4 wherein a face plate extends from the floor to the top of said shelf member to conceal the space under said shelf member and said horizontal channel members.

* * * * *